US011089938B2

(12) United States Patent
Lee

(10) Patent No.: US 11,089,938 B2
(45) Date of Patent: Aug. 17, 2021

(54) DISHWASHER AND CONTROL METHOD THEREOF

(71) Applicant: LG Electronics Inc., Seoul (KR)

(72) Inventor: Sangik Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/493,248

(22) PCT Filed: Mar. 9, 2018

(86) PCT No.: PCT/KR2018/002819
§ 371 (c)(1),
(2) Date: Sep. 11, 2019

(87) PCT Pub. No.: WO2018/164530
PCT Pub. Date: Sep. 13, 2018

(65) Prior Publication Data

US 2020/0113409 A1 Apr. 16, 2020

(30) Foreign Application Priority Data

Mar. 9, 2017 (KR) ..... 10-2017-0030246

(51) Int. Cl.
*A47L 15/42* (2006.01)
*A47L 15/00* (2006.01)
*B01F 3/04* (2006.01)

(52) U.S. Cl.
CPC ..... *A47L 15/4282* (2013.01); *A47L 15/0031* (2013.01); *A47L 15/4223* (2013.01);
(Continued)

(58) Field of Classification Search
None
See application file for complete search history.

(56) References Cited

FOREIGN PATENT DOCUMENTS

JP S63125229 5/1988
JP 2003275158 9/2003
(Continued)

OTHER PUBLICATIONS

Google Patents translation of KR20060103987, retrieved Nov. 3, 2020 (Year: 2020).*
(Continued)

*Primary Examiner* — Eric W Golightly
(74) *Attorney, Agent, or Firm* — Fish & Richardson P.C.

(57) ABSTRACT

Disclosed is a dishwasher ejecting wash water containing microbubbles. The dishwasher according to an embodiment includes a tub accommodating dishes therein, a plurality of wash arms spraying wash water into the tub, a bubble nozzle ejecting wash water containing microbubbles to the bottom of the tub, a sump disposed below the bottom of the tub and collecting wash water therein, a wash pump pumping wash water collected in the sump, a channel-switching unit supplying wash water pumped by the wash pump to at least one of the plurality of wash arms, and a bubble module generating microbubbles in wash water pumped by the wash pump and supplying the wash water containing microbubbles to the bubble nozzle, and a controller operates the wash pump and controls the channel-switching unit and the bubble module to spray wash water through at least one of the plurality of wash arms and simultaneously to eject wash water through the bubble nozzle.

11 Claims, 6 Drawing Sheets

(52) U.S. Cl.
CPC ..... *A47L 15/4285* (2013.01); *B01F 3/04248* (2013.01); *A47L 2401/30* (2013.01); *A47L 2501/02* (2013.01); *A47L 2501/06* (2013.01)

(56) References Cited

FOREIGN PATENT DOCUMENTS

| | | | | |
|---|---|---|---|---|
| JP | 2004313633 | | | 11/2004 |
| JP | 2008086868 | | | 4/2008 |
| JP | 2008119151 | A | * | 5/2008 |
| JP | 2008168026 | | | 7/2008 |
| KR | 20060103987 | A | * | 10/2006 |
| KR | 1020150079398 | | | 7/2015 |

OTHER PUBLICATIONS

Google Patents translation of JP2008119151, retrieved Nov. 3, 2020 (Year: 2020).*
Extended European Search Report in European Appln. No. 18764094.1, dated Nov. 26, 2020, 9 pages.
PCT International Search Report in International Appln. No. PCT/KR2018/002819, dated Jul. 16, 2018, 7 pages (with English translation).

* cited by examiner

DISHWASHER AND CONTROL METHOD THEREOF

CROSS-REFERENCE TO RELATED APPLICATIONS

This application is a National Stage application under 35 U.S.C. § 371 of International Application No. PCT/KR2018/002,819, filed on Mar. 9, 2018, which claims the benefit of Korean Application No. 10-2017-0030246, filed on Mar. 9, 2017. The disclosures of the prior applications are incorporated by reference in their entirety.

TECHNICAL FIELD

The present invention relates to a dishwasher and a control method thereof, and more particularly to a dishwasher, which ejects wash water containing microbubbles, and a control method thereof.

BACKGROUND ART

Dishwashers are appliances that remove food residue from dishes using high-pressure wash water sprayed from wash arms.

Dishwashers usually include a tub forming a washing chamber and a sump mounted in the bottom of the tub and storing wash water. The wash water is pumped to wash arms by a wash pump in the sump, and the wash water pumped to the wash arms is sprayed at high pressure through spray holes formed in the wash arms. The wash water sprayed at high pressure hits dishes, so that the contamination such as food residue on the dishes falls down to the bottom of the tub.

If the contamination on the bottom of the tub is left behind without flowing to the sump together with the wash water, odors may be generated and bacteria may proliferate.

DISCLOSURE

Technical Problem

Therefore, the present invention has been made in view of the above problems, and it is an object of the present invention to provide a dishwasher for removing contamination that has fallen down to the bottom of a tub due to wash water sprayed through a wash arm and a control method thereof.

However, the objects to be accomplished by the invention are not limited to the above-mentioned objects, and other objects not mentioned herein will be clearly understood by those skilled in the art from the following description.

Technical Solution

In accordance with the present invention, the above and other objects can be accomplished by the provision of a dishwasher including a tub accommodating dishes therein, a plurality of wash arms spraying wash water into the tub, a bubble nozzle ejecting wash water containing microbubbles to the bottom of the tub, a sump disposed below the bottom of the tub and collecting wash water therein, a wash pump pumping wash water collected in the sump, a channel-switching unit supplying wash water pumped by the wash pump to at least one of the plurality of wash arms, and a bubble module generating microbubbles in wash water pumped by the wash pump and supplying the wash water containing microbubbles to the bubble nozzle, and a controller operates the wash pump and controls the channel-switching unit and the bubble module to spray wash water through at least one of the plurality of wash arms and simultaneously to eject wash water through the bubble nozzle.

The controller may control a plurality of bubble modules to alternately eject wash water through a plurality of bubble nozzles. In addition, the controller may control the plurality of bubble modules to simultaneously eject wash water through the plurality of bubble nozzles after alternately ejecting wash water.

The controller may control a water supply valve to supply wash water supplied from an external water source to the sump, and thereafter may control the wash pump and the bubble module to eject wash water through the bubble nozzle.

The controller may control a heater to heat wash water supplied to the sump, and thereafter may control the wash pump and the bubble module to eject heated wash water through the bubble nozzle.

The controller may control the wash pump and the bubble module to stop ejection of wash water through the bubble nozzle, and thereafter may control a drain pump to discharge wash water collected in the sump outside.

When the magnitude of current of the wash pump is equal to or less than a predetermined value, the controller may control the bubble module to prevent ejection of wash water through the bubble nozzle.

In accordance with the present invention, the above and other objects can be accomplished by the provision of a control method of a dishwasher, including a water supply step of supplying wash water supplied from an external water source to a sump, and a washing step of spraying wash water through at least one of a plurality of wash arms and simultaneously ejecting wash water containing microbubbles through a bubble nozzle, thereby removing contamination that has fallen down to the bottom of the tub.

The washing step may include alternately ejecting wash water through a plurality of bubble nozzles. In addition, the washing step may further include simultaneously ejecting wash water through the plurality of bubble nozzles after the alternately ejecting wash water.

The method may further include, after the water supply step, a heating step of heating wash water collected in the sump.

The method may further include, after the washing step, a drain step of discharging wash water collected in the sump outside.

Details of other embodiments are included in the detailed description and the accompanying drawings.

Advantageous Effects

According to a dishwasher and a control method thereof of the present invention, there are one or more effects as follows.

First, contamination that has fallen down to the bottom of a tub due to wash water sprayed through wash arms is removed by wash water ejected through bubble nozzles provided in the bottom of the tub. Particularly, the plurality of bubble nozzles ejects wash water alternately or simultaneously, so that the contamination on the bottom of the tub is collected in a sump.

Second, in the cycles of preliminary washing and main washing, spraying of wash water through the wash arms and ejection of wash water through the bubble nozzles are performed at the same time, so that the contamination that falls down to the bottom of the tub is immediately collected in the sump, and thus the contamination is prevented from sticking to the tub. In addition, the bubble nozzles eject wash water containing microbubbles to the bottom of the tub to sterilize the bottom of the tub. Particularly, in the cycle of main washing, the bubble nozzles eject heated wash water to sterilize the bottom of the tub.

Third, in the cycles of rinsing or hot rinsing, the ejection of wash water through the bubble nozzles is stopped in order to spray high-pressure wash water through the wash arms. In addition, when it is difficult to pump wash water at a high pressure due to the low magnitude of current of a wash pump, only the spraying of wash water through the wash arms is performed by stopping the ejection of wash water through the bubble nozzles.

However, the effects achievable through the invention are not limited to the above-mentioned effects, and other effects not mentioned herein will be clearly understood by those skilled in the art from the appended claims.

BEST MODE

Figure 1:
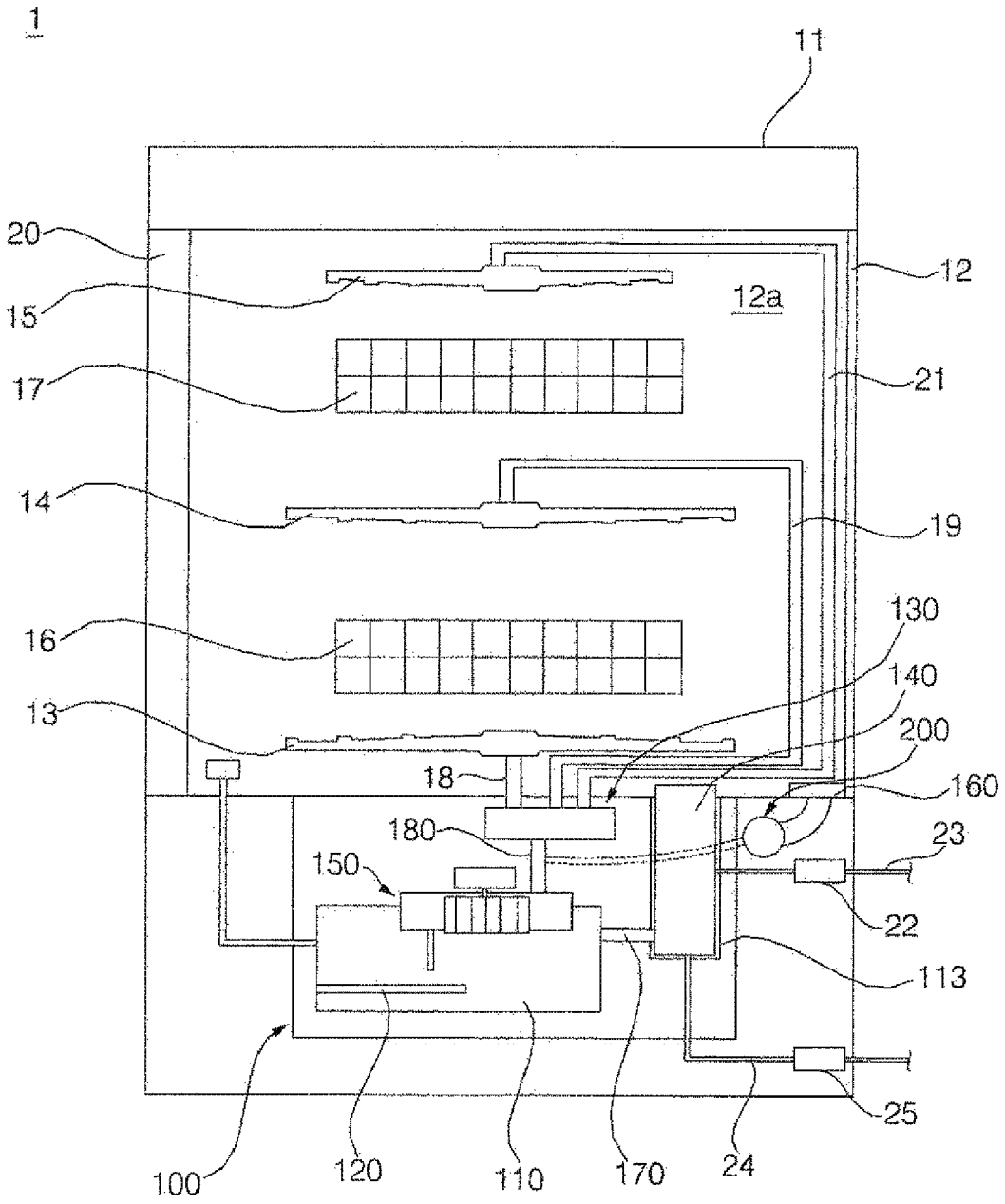
FIG. 1 is a longitudinal-sectional view of a dishwasher according to an embodiment of the present invention.

Advantages and features of the present invention and methods for achieving them will be made clear from the embodiments described below in detail with reference to the accompanying drawings. The present invention may, however, be embodied in many different forms, and should not be construed as being limited to the embodiments set forth herein. Rather, these embodiments are provided so that this disclosure will be thorough and complete, and will fully convey the scope of the invention to those skilled in the art. The present invention is merely defined by the scope of the claims. Like reference numerals refer to like elements throughout the specification.

Hereinafter, embodiments of the present invention will be described with reference to the accompanying drawings for explaining a dishwasher and a control method thereof.

Figure 2:
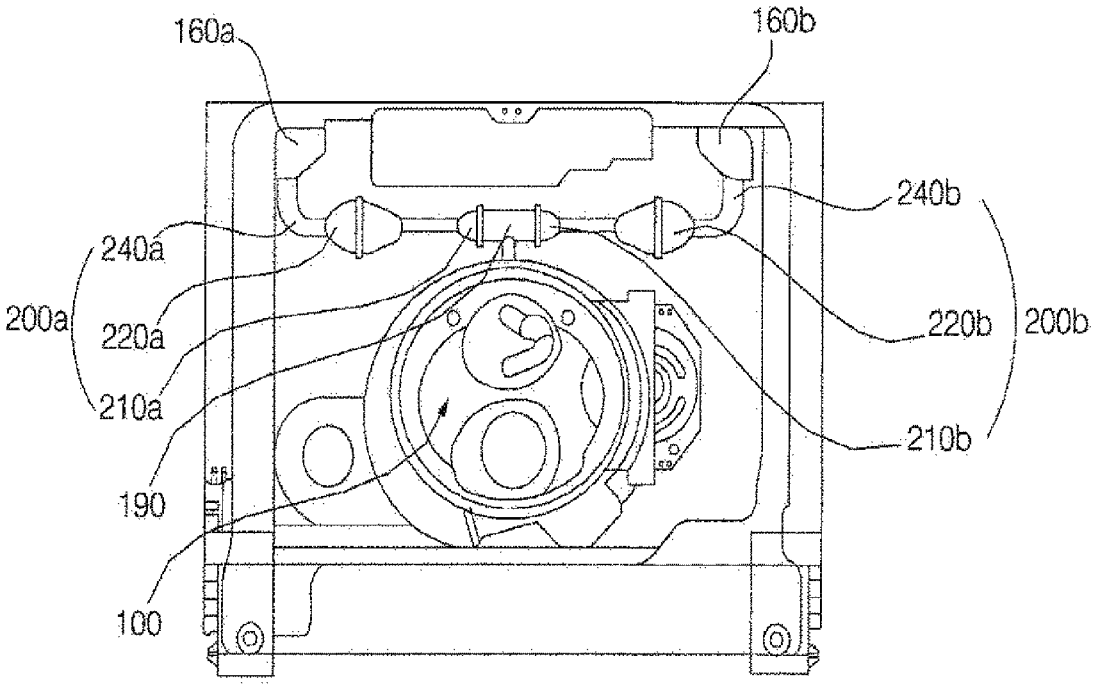
FIG. 2 is a cross-sectional view of the dishwasher according to the embodiment of the present invention.
Figure 3:
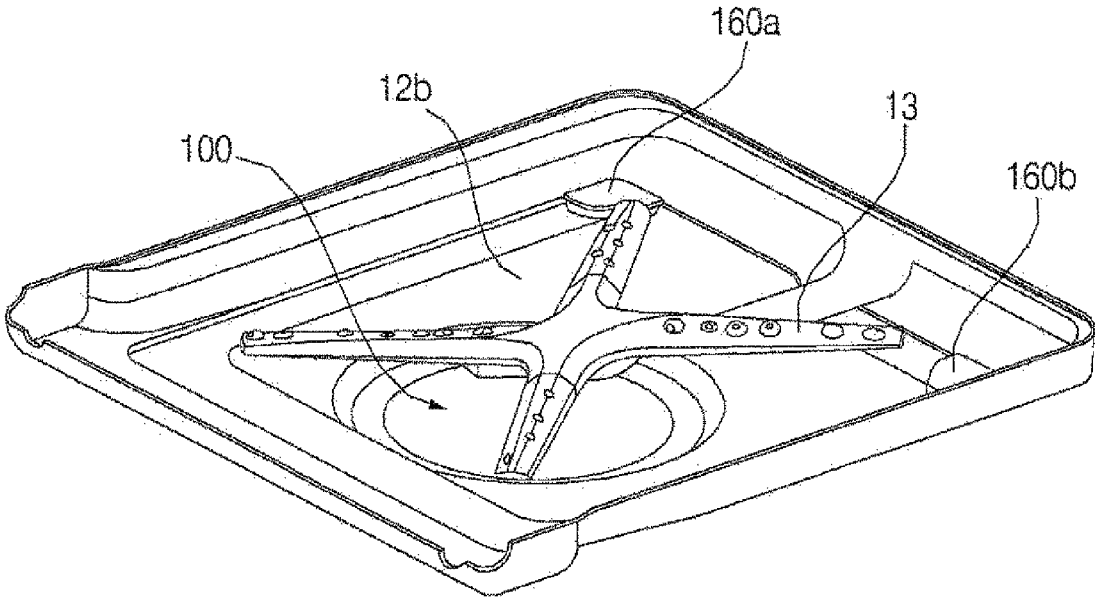
FIG. 3 is a partial perspective view of the dishwasher according to the embodiment of the present invention.

FIG. 1 is a longitudinal-sectional view of a dishwasher according to an embodiment of the present invention, FIG. 2 is a cross-sectional view of the dishwasher according to the embodiment of the present invention, and FIG. 3 is a partial perspective view of the dishwasher according to the embodiment of the present invention.

A dishwasher 1 according to an embodiment of the present invention includes a case 11, which forms the external appearance thereof, a tub 12 in which dishes are accommodated, a door 20, which is provided on the front surface of the tub 12 and opens and closes a washing chamber 12*a*, a sump 100, which is disposed below the tub 12 and collects wash water therein, a plurality of wash arms 13, 14 and 15, which spray wash water into the tub 12, bubble nozzles 160*a* and 160*b*, which eject wash water containing microbubbles to the bottom 12*a* of the tub 12, a wash pump 150, which pumps the wash water collected in the sump 100, a channel-switching unit 130, which supplies wash water pumped by the wash pump 150 to at least one of the plurality of wash arms 13, 14 and 15, and bubble modules 200*a* and 200*b*, which generate microbubbles in the wash water pumped by the wash pump 150 and supply the wash water containing microbubbles to the bubble nozzles 160*a* and 160*b*.

The tub 11 is formed in a hexahedral shape having an open front surface, and forms the washing chamber 12*a* therein. The washing chamber 12*a* is provided therein with a plurality of racks 16 and 17 for receiving dishes therein. The plurality of racks 16 and 17 include a lower rack 16 disposed at a lower portion of the washing chamber 12*a* and an upper rack 17 disposed at an upper portion thereof. The lower rack 16 and the upper rack 17 are vertically spaced apart from each other, and are configured to slide in the forward direction of the tub 11 so as to be drawn out.

The plurality of wash arms 13, 14 and 15 include a lower wash arm 13, which sprays wash water from the lower side to the upper side toward the lower rack 16, an upper wash arm 14, which sprays wash water from the upper side to the lower side toward the lower rack 16, and a top wash arm 15, which sprays wash water from the upper side to the lower side toward the upper rack 17.

The plurality of wash arms 13, 14 and 15 receive wash water from the wash pump 150 through a plurality of wash arm connection channels 18, 19 and 21. The plurality of wash arm connection channels 18, 19 and 21 include a lower wash arm connection channel 18 connected to the lower wash arm 13, an upper wash arm connection channel 19 connected to the upper wash arm 14, and a top wash arm connection channel 21 connected to the top wash arm 15.

The lower wash arm 13, the upper wash arm 14, and the top wash arm 15 receive wash water from the wash pump 150 through the lower wash arm connection channel 18, the upper wash arm connection channel 19, and the top wash arm connection channel 21, respectively.

The sump 100 is disposed below the center portion of the bottom 12*a* of the tub 12 and collects wash water therein. The sump 100 includes a water-collecting unit 110, in which the collected wash water is stored, a filter-mounting unit 113, through which the sump 100 communicates with the tub 12 and in which a filter 140 is mounted, and a water-collecting channel 170, which guides the wash water flowing through the filter-mounting unit 113 to the water-collecting unit 110.

The filter-mounting unit 113 is formed so as to be recessed downwards so that wash water flowing into the sump 100 from the tub 12 is smoothly collected therein. The filter 140 is removably provided in the filter-mounting unit 113. The filter 140 filters foreign substances such as food residue floating in the wash water. The filter 140 is detachably mounted in the filter-mounting unit 113. The wash water introduced from the tub 12 into the filter-mounting unit 113 is filtered by the filter 140 and is then guided to the water-collecting unit 110 through the water-collecting channel 170.

The water-collecting unit 110 stores the wash water that has passed through the water-collecting channel 170 via the filter-mounting unit 113 from the tub 12. The wash water collected in the water-collecting unit 110 is moved to at least one of the plurality of wash arms 13, 14 and 15 and/or to at least one of the plurality of bubble modules 200*a* and 200*b* by the wash pump 150.

The wash pump 150 pumps the wash water stored in the water-collecting unit 110 to at least one of the plurality of channel-switching units 130 and/or to at least one of the plurality of bubble modules 200*a* and 200*b*. The wash pump 150 includes a wash motor configured to generate rotational force and an impeller configured to be rotated by the wash motor to move the wash water.

When the wash pump 150 operates, at least one of the plurality of wash arms 13, 14 and 15 sprays wash water, or at least one of the plurality of bubble nozzles 160*a* and 160*b* ejects wash water. The wash water sprayed and/or ejected into the tub 12 flows into the sump 100. In this way, the wash water circulates between the sump 100 and the tub 12.

The channel-switching unit 130 selectively supplies the wash water pumped by the wash pump 150 to at least one of the lower wash arm 13, the upper wash arm 14, or the top wash arm 15. The dishwasher 1 includes a wash water supply channel 180, which is provided at the sump 100 and guides the wash water pumped by the wash pump 150 to the channel-switching unit 130. The channel-switching unit 130 selectively connects the wash water supply channel 180 to at least one of the plurality of wash arm connection channels 18, 19 and 21.

The dishwasher 1 includes a water supply channel 23 through which the wash water supplied from an external water source flows, and a water supply valve 22, which opens and blocks the water supply channel 23. In the embodiment, the water supply channel 23 is directly connected to the filter-mounting unit 113 of the sump 100, and the wash water supplied from the external water source through the water supply channel 23 passes through the filter 140 and then flows to the water-collecting unit 110. In some embodiments, the water supply channel 23 may be directly connected to the tub 12, and the wash water supplied from the external water source through the water supply channel 23 may be supplied into the tub 12.

The dishwasher 1 includes a drain channel 24, which is connected to the filter-mounting unit 113 of the sump 100 and guides the wash water in the sump 100 to the outside of the dishwasher 1, and a drain pump 25, which is disposed in the drain channel 24 and pumps the wash water to discharge the wash water outside the dishwasher 1. When the drain pump 25 operates, the wash water introduced into the filter-mounting unit 113 of the sump 100 is discharged outside the case 11 through the drain channel 24. The drain pump 25 is controlled so as to stop the operation thereof when no load is sensed.

The dishwasher 1 includes a heater 120 for heating the wash water stored in the water-collecting unit 110 of the sump 100. The heater 120 heats the wash water that is supplied from the external water source by the water supply valve 22 and is stored in the water-collecting unit 110.

The bubble modules 200*a* and 200*b* generate microbubbles in the wash water pumped by the wash pump 150 and supply the wash water containing microbubbles to the bubble nozzles 160*a* and 160*b*. The bubble modules 200*a* and 200*b* may be provided in a plural number. The dishwasher 1 includes a wash water distribution channel 190, which is provided in the sump 100 and guides the wash water pumped by the wash pump 150 to the plurality of bubble modules 200*a* and 200*b* in a distributed manner. The bubble modules 200*a* and 200*b* are connected to the wash water distribution channel 190 and are disposed so as to respectively extend to the lower-rear-left side and the lower-rear-right side of the tub 12. In the embodiment, the plurality of bubble modules 200*a* and 200*b* may include a first bubble module 200*a*, which is disposed at the lower-rear-left side of the tub 12, and a second bubble module 200*b*, which is disposed at the lower-rear-right side of the tub 12.

The bubble modules 200*a* and 200*b* include bubble valves 210*a* and 210*b* for controlling the flow of the wash water guided by the wash water distribution channel 190, bubble generators 220*a* and 220*b* for generating microbubbles in the wash water, and bubble connection channels 240*a* and 240*b* for guiding the wash water containing microbubbles to the bubble nozzles 160*a* and 160*b*. The first bubble module 200*a* includes the first bubble valve 210*a*, the first bubble generator 220*a*, and the first bubble connection channel 240*a*. The second bubble module 200*b* includes the second bubble valve 210*b*, the second bubble generator 220*b*, and the second bubble connection channel 240*b*.

When the first bubble valve 210*a* is opened, the wash water that is pumped to the wash water distribution channel 190 by the wash pump 150 enters the first bubble generator 220*a*, and the wash water containing the microbubbles generated by the first bubble generator 220*a* is ejected through the first bubble nozzle 160*a*. When the second bubble valve 210*b* is opened, the wash water that is pumped to the wash water distribution channel 190 by the wash pump 150 enters the second bubble generator 220*b*, and the wash water containing the microbubbles generated by the second bubble generator 220*b* is ejected through the second bubble nozzle 160*b*.

The structure of the bubble modules 200*a* and 200*b* will be described in detail later with reference to FIG. 4.

The bubble nozzles 160*a* and 160*b* eject the wash water containing microbubbles supplied from the bubble modules 200*a* and 200*b* through the bubble connection channels 240*a* and 240*b*. The bubble nozzles 160*a* and 160*b* are disposed on the top surface of the bottom 12*a* of the tub 12 and eject wash water containing microbubbles to the bottom 12*a* of the tub 12. The bubble nozzles 160*a* and 160*b* are preferably disposed at the corners of the bottom 12*a* of the tub 12. The bubble nozzles 160*a* and 160*b* eject wash water to the bottom 12*a* of the tub 12, so that the contamination on the bottom 12*a* of the tub 12 is collected in the filter-mounting unit 113 of the sump 100. In addition, the microbubbles contained in the wash water ejected through the bubble nozzles 160*a* and 160*b* sterilize the bottom 12*a* of the tub 12.

The bubble nozzles 160*a* and 160*b* are provided in a plural number so as to match the number of bubble modules 200*a* and 200*b*. In the embodiment, the plurality of bubble nozzles 160*a* and 160*b* include the first bubble nozzle 160*a*, which is disposed at the rear-left side of the bottom 12*a* of the tub 12, and the second bubble nozzle 160*b*, which is disposed at the rear-right side of the bottom 12*a* of the tub 12. The first bubble nozzle 160*a* and the second bubble nozzle 160*b* are formed so as to eject wash water in a radial shape toward the center portion of the bottom 12*a* of the tub 12.

Figure 4:
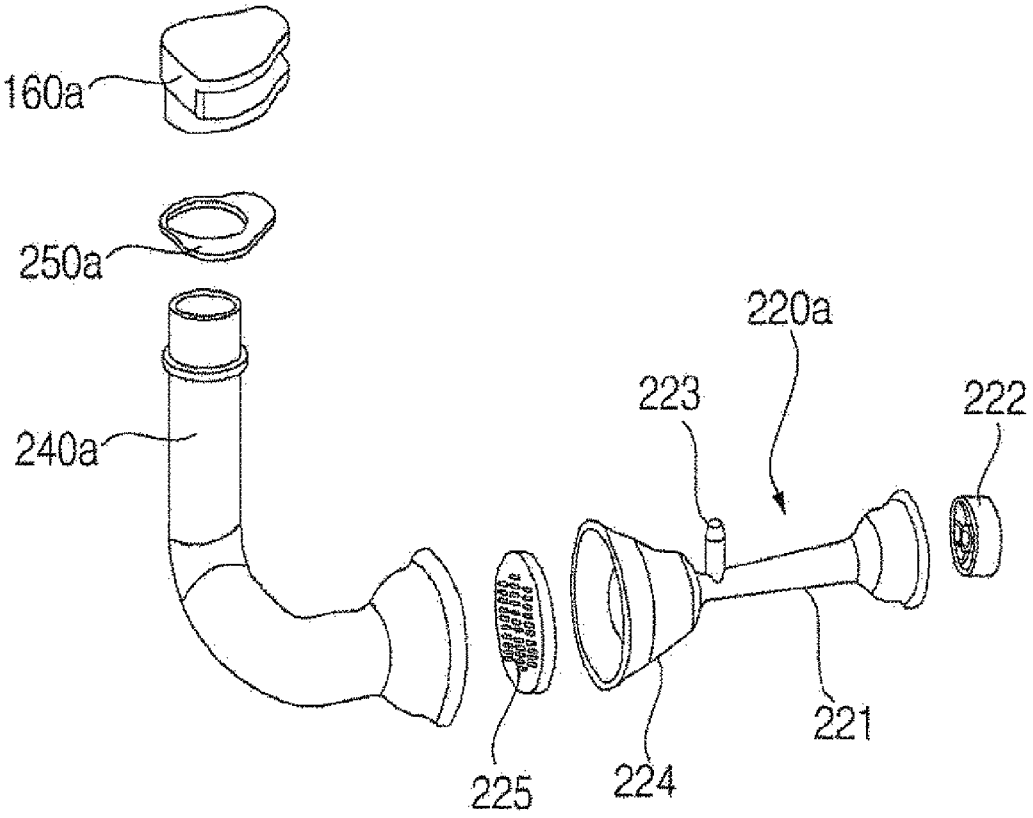
FIG. 4 is an exploded view of a bubble module according to an embodiment of the present invention.

FIG. 4 is an exploded view of the bubble module according to an embodiment of the present invention.

The first bubble module 200*a* and the second bubble module 200*b* have the same structure as each other, and thus the following description will be made only with reference to the first bubble module 200*a*.

The bubble generator 220*a* includes an impeller 222, which applies centrifugal force to the wash water that flows, a decompression portion 221, which reduces the pressure of the wash water that has passed through the impeller 222, an air suction portion 223, which injects air into the decompression portion 221, a pressurizing portion 224, which increases the pressure of the wash water so as to crush the air introduced from the air suction portion 223, and an air tap 225, which has a plurality of holes formed therein so as to crush the air contained in the wash water that has passed through the pressurizing portion 224.

The bubble module 200*a* includes a sealing member 250*a* for realizing a seal between the bubble connection channel 240*a* and the bubble nozzle 160*a*.

Figure 5:
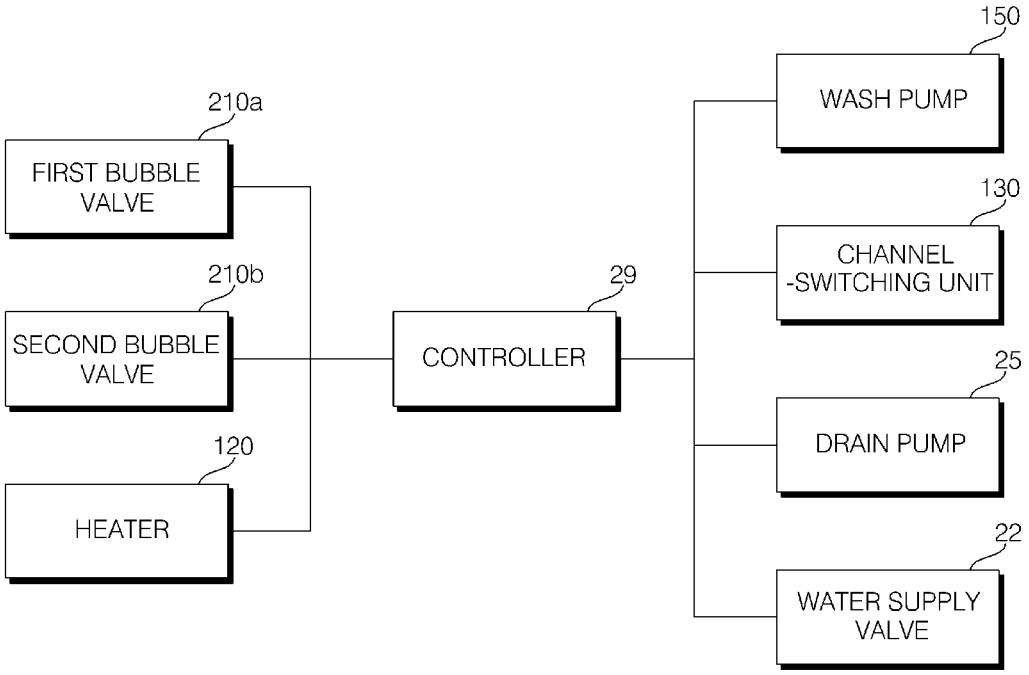
FIG. 5 is a block diagram of the dishwasher according to the embodiment of the present invention.
Figure 6:
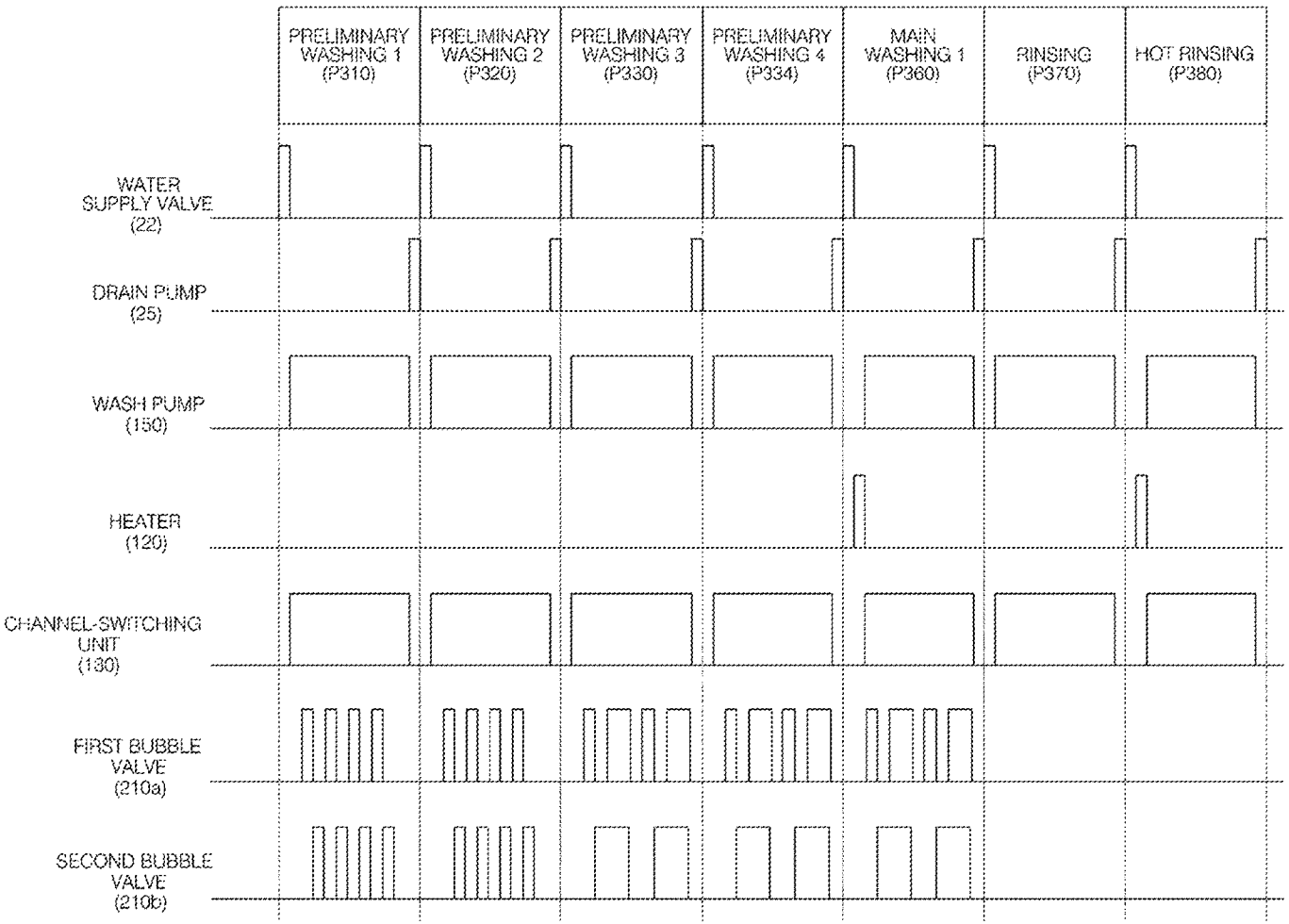
FIG. 6 is a view showing a control method of the dishwasher according to an embodiment of the present invention.

FIG. 5 is a block diagram of the dishwasher according to the embodiment of the present invention, and FIG. 6 is a view showing a control method of the dishwasher according to an embodiment of the present invention.

A controller 29 controls the water supply valve 22, the drain pump 25, the wash pump 150, the heater 120, the channel-switching unit 130, the first bubble valve 210*a*, and the second bubble valve 210*b* in order to wash dishes. The controller 29 performs each cycle according to the wash course selected by a user.

During a standard dish-washing course, the controller 29 sequentially performs preliminary washing 1 P310, preliminary washing 2 P320, preliminary washing 3 P330, preliminary washing 4 P340, main washing P360, rinsing P370, and hot rinsing P380.

The cycles of preliminary washing P310, P320, P330 and P340 are performed to remove large debris from dishes by spraying wash water to the dishes. Each cycle of preliminary washing P310, P320, P330 and P340 includes a water supply process, a washing process, and a drain process.

In the water supply process of each cycle of preliminary washing P310, P320, P330 and P340, the controller 29 controls the water supply valve 22 to supply wash water from an external water source to the sump 100. The controller 29 supplies a predetermined amount of wash water, required for washing, to the sump 100 according to the amount of dishes or the course selected by the user.

In the washing process of each cycle of preliminary washing P310, P320, P330 and P340, the controller 29 operates the wash pump 150 to pump the wash water in the sump 100, controls the channel-switching unit 130 to spray the wash water through at least one of the plurality of wash arms 13, 14 and 15, and at the same time opens at least one of the plurality of bubble valves 210*a* and 210*b* to eject the wash water through at least one of the plurality of bubble nozzles 160*a* and 160*b*. The wash water sprayed through at least one of the plurality of wash arms 13, 14 and 15 causes the contamination on the dishes to fall down to the bottom 12*a* of the tub 12, and the wash water ejected through at least one of the plurality of bubble nozzles 160*a* and 160*b* causes the contamination that has fallen down to the bottom 12*a* of the tub 12 to be collected in the filter-mounting unit 113 of the sump 100.

Upon operating the wash pump 150, the controller 29 controls the channel-switching unit 130 to supply wash water to at least one of the plurality of wash arms 13, 14 and 15 and opens at least one of the plurality of bubble nozzles 160*a* and 160*b* to supply wash water to at least one of the plurality of bubble nozzles 160*a* and 160*b*.

The controller 29 stops the operation of the wash pump 150 in order to stop the spraying of wash water through the plurality of wash arms 13, 14 and 15 as well as the ejection of wash water through the plurality of bubble nozzles 160*a* and 160*b*.

The controller 29 controls the channel-switching unit 130 so that at least one of the plurality of wash arms 13, 14 and 15 sequentially sprays wash water at predetermined time intervals. The controller 29 sequentially operates at least one of the plurality of bubble modules 200*a* and 200*b* at predetermined time intervals.

In the cycle of preliminary washing 1 P310, the controller 29 controls the channel-switching unit 130 to spray wash water through the lower wash arm 13 for a predetermined amount of time and then to spray wash water through the top wash arm 15 for a predetermined amount of time. In addition, in the cycle of preliminary washing 1 P310, the controller 29 repeatedly performs the operation of opening the first bubble valve 210*a* for a predetermined amount of time to eject wash water through the first bubble nozzle 160*a* and then opening the second bubble valve 210*b* for a predetermined amount of time to eject wash water through the second bubble nozzle 160*b*.

In the cycle of preliminary washing 2 P320, the controller 29 controls the channel-switching unit 130 to spray wash water through the lower wash arm 13 for a predetermined amount of time and then to spray wash water through the top wash arm 15 for a predetermined amount of time. In addition, in the cycle of preliminary washing 2 P320, the controller 29 repeatedly performs the operation of opening the first bubble valve 210*a* for a predetermined amount of time to eject wash water through the first bubble nozzle 160*a* and then opening the second bubble valve 210*b* for a predetermined amount of time to eject wash water through the second bubble nozzle 160*b*.

In the cycle of preliminary washing 3 P330, the controller 29 controls the channel-switching unit 130 to spray wash water through the lower wash arm 13 for a predetermined amount of time, to spray wash water through the upper wash arm 14 for a predetermined amount of time, and then to spray wash water through the top wash arm 15 for a predetermined amount of time. In addition, in the cycle of preliminary washing 3 P330, the controller 29 repeatedly performs the operation of opening the first bubble valve 210*a* for a predetermined amount of time to eject wash water through the first bubble nozzle 160*a*, opening the second bubble valve 210*b* for a predetermined amount of time to eject wash water through the second bubble nozzle 160*b*, and then opening the first bubble valve 210*a* and the second bubble valve 210*b* at the same time to eject wash water through the first bubble nozzle 160*a* and the second bubble nozzle 160*b* at the same time.

In the cycle of preliminary washing 4 P340, the controller 29 controls the channel-switching unit 130 to spray wash water through the lower wash arm 13 and the top wash arm 15 at the same time for a predetermined amount of time and then to spray wash water through the upper wash arm 14 for a predetermined amount of time. In addition, in the cycle of preliminary washing 4 P340, the controller 29 repeatedly performs the operation of opening the first bubble valve 210*a* for a predetermined amount of time to eject wash water through the first bubble nozzle 160*a*, opening the second bubble valve 210*b* for a predetermined amount of time to eject wash water through the second bubble nozzle 160*b*, and then opening the first bubble valve 210*a* and the second bubble valve 210*b* at the same time to eject wash water through the first bubble nozzle 160*a* and the second bubble nozzle 160*b* at the same time.

In the drain process of each cycle of preliminary washing P310, P320, P330 and P340, the controller 29 operates the drain pump 25 to discharge the wash water in the sump 100 outside. The controller 29 stops the operation of the drain pump 25 when no load is sensed in the drain pump 25.

The cycle of main washing P360 is performed to heat dishes by spraying heated wash water to the dishes and to remove contamination from the dishes. The cycle of main washing P360 includes a water supply process, a heating process, a washing process, and a drain process.

In the water supply process of the cycle of main washing P360, the controller 29 controls the water supply valve 22 to supply wash water from an external water source to the sump 100. In the heating process of the cycle of main washing P360, the controller 29 controls the heater 120 to heat the wash water stored in the water-collecting unit 110 of the sump 100.

In the washing process of the cycle of main washing P360, the controller 29 operates the wash pump 150 to pump the wash water in the sump 100, controls the channel-switching unit 130 to spray the heated wash water through at least one of the plurality of wash arms 13, 14 and 15, and at the same time opens at least one of the plurality of bubble valves 210*a* and 210*b* to eject the heated wash water through at least one of the plurality of bubble nozzles 160*a* and 160*b*. The wash water sprayed through at least one of the plurality of wash arms 13, 14 and 15 causes the contamination on the dishes to fall down to the bottom 12*a* of the tub 12, and the wash water ejected through at least one of the plurality of bubble nozzles 160*a* and 160*b* causes the contamination that has fallen down to the bottom 12*a* of the tub 12 to be collected in the filter-mounting unit 113 of the sump 100. In addition, the wash water ejected through at least one of the plurality of bubble nozzles 160*a* and 160*b* sterilizes the bottom 12*a* of the tub 12.

Upon operating the wash pump 150, the controller 29 controls the channel-switching unit 130 to supply wash water to at least one of the plurality of wash arms 13, 14 and 15 and opens at least one of the plurality of bubble nozzles 160*a* and 160*b* to supply wash water to at least one of the plurality of bubble nozzles 160*a* and 160*b*.

The controller 29 stops the operation of the wash pump 150 in order to stop the spraying of wash water through the plurality of wash arms 13, 14 and 15 as well as the ejection of wash water through the plurality of bubble nozzles 160*a* and 160*b*.

In the cycle of main washing P360, the controller 29 controls the channel-switching unit 130 to spray wash water through the lower wash arm 13 and the top wash arm 15 at the same time for a predetermined amount of time and then to spray wash water through the upper wash arm 14 for a predetermined amount of time. In addition, in the cycle of main washing P360, the controller 29 repeatedly performs the operation of opening the first bubble valve 210*a* for a predetermined amount of time to eject wash water through the first bubble nozzle 160*a*, opening the second bubble valve 210*b* for a predetermined amount of time to eject wash water through the second bubble nozzle 160*b*, and then opening the first bubble valve 210*a* and the second bubble valve 210*b* at the same time to eject wash water through the first bubble nozzle 160*a* and the second bubble nozzle 160*b* at the same time.

In the drain process of the cycle of main washing P360, the controller 29 operates the drain pump 25 to discharge the wash water in the sump 100 outside. The controller 29 stops the operation of the drain pump 25 when no load is sensed in the drain pump 25.

The cycle of rising P370 is performed to remove the contamination remaining on the dishes by spraying wash water to the dishes. The cycle of rinsing P370 includes a water supply process, a washing process, and a drain process.

In the water supply process of the cycle of rinsing P370, the controller 29 controls the water supply valve 22 to supply wash water from an external water source to the sump 100.

In the washing process of the cycle of rinsing P370, the controller 29 operates the wash pump 150 to pump the wash water in the sump 100, and controls the channel-switching unit 130 to spray the wash water through at least one of the plurality of wash arms 13, 14 and 15. The wash water sprayed through at least one of the plurality of wash arms 13, 14 and 15 causes the contamination remaining on the dishes to fall down to the bottom 12*a* of the tub 12. In the washing process of the cycle of rinsing P370, it is required to spray high-pressure wash water through at least one of the plurality of wash arms 13, 14 and 15. Therefore, the controller 29 closes all of the plurality of bubble valves 210*a* and 210*b* to prevent the wash water from being ejected through the plurality of bubble nozzles 160*a* and 160*b*. In the washing process of the cycle of rinsing P370, since the amount of remaining contamination that falls from the dishes is very small, the contamination that has fallen down to the bottom 12*a* of the tub 12 is collected in the filter-mounting unit 113 without ejection of wash water through the plurality of bubble nozzles 160*a* and 160*b*.

Upon operating the wash pump 150, the controller 29 controls the channel-switching unit 130 to supply wash water to at least one of the plurality of wash arms 13, 14 and 15. The controller 29 stops the operation of the wash pump 150 in order to stop the spraying of wash water through the plurality of wash arms 13, 14 and 15.

In the cycle of rinsing P370, the controller 29 controls the channel-switching unit 130 to spray wash water through the lower wash arm 13 and the top wash arm 15 at the same time for a predetermined amount of time and then to spray wash water through the upper wash arm 14 for a predetermined amount of time.

In the drain process of the cycle of rinsing P370, the controller 29 operates the drain pump 25 to discharge the wash water in the sump 100 outside. The controller 29 stops the operation of the drain pump 25 when no load is sensed in the drain pump 25.

The cycle of hot rinsing P380 is performed to heat the dishes by spraying the heated wash water to the dishes. The cycle of rinsing P370 includes a water supply process, a heating process, a washing process, and a drain process.

In the water supply process of the cycle of hot rinsing P380, the controller 29 controls the water supply valve 22 to supply wash water from an external water source to the sump 100. In the heating process of the cycle of hot rinsing P380, the controller 29 controls the heater 120 to heat the wash water stored in the water-collecting unit 110 of the sump 100. In the washing process of the cycle of hot rinsing P380, the controller 29 operates the wash pump 150 to pump the heated wash water in the sump 100, and controls the channel-switching unit 130 to spray the wash water through at least one of the plurality of wash arms 13, 14 and 15. The wash water sprayed through at least one of the plurality of wash arms 13, 14 and 15 heats the dishes. In the washing process of the cycle of hot rinsing P380, it is required to spray high-pressure wash water through at least one of the plurality of wash arms 13, 14 and 15. Therefore, the controller 29 closes all of the plurality of bubble valves 210*a* and 210*b* to prevent the wash water from being ejected through the plurality of bubble nozzles 160*a* and 160*b*.

Upon operating the wash pump 150, the controller 29 controls the channel-switching unit 130 to supply wash water to at least one of the plurality of wash arms 13, 14 and 15. The controller 29 stops the operation of the wash pump 150 in order to stop the spraying of wash water through the plurality of wash arms 13, 14 and 15.

In the cycle of hot rinsing P380, the controller 29 controls the channel-switching unit 130 to spray wash water through the lower wash arm 13 for a predetermined amount of time, to spray wash water through the upper wash arm 14 for a predetermined amount of time, and then to spray wash water through the top wash arm 15 for a predetermined amount of time.

In the drain process of the cycle of hot rinsing P380, the controller 29 operates the drain pump 25 to discharge the wash water in the sump 100 outside. The controller 29 stops the operation of the drain pump 25 when no load is sensed in the drain pump 25.

In the plurality of cycles of preliminary washing P310, P320, P330 and P340 and the cycle of main washing P360 described above, when the magnitude of current of the wash motor of the wash pump 150 decreases to a predetermined value or lower, it is preferable to block all of the plurality of bubble nozzles 160*a* and 160*b*. When the magnitude of current of the wash motor of the wash pump 150 decreases to a predetermined value or lower, the pressure of the wash water sprayed through the plurality of wash arms 13, 14 and 15 may decrease. Therefore, all of the plurality of bubble nozzles 160*a* and 160*b* are blocked to prevent the wash water from being ejected through the plurality of bubble nozzles 160*a* and 160*b*.

It will be apparent that, although the preferred embodiments have been shown and described above, the present invention is not limited to the above-described specific embodiments, and various modifications and variations can be made by those skilled in the art without departing from the gist of the appended claims. Thus, it is intended that the modifications and variations should not be understood independently of the technical spirit or prospect of the present invention.

The invention claimed is:

1. A dishwasher comprising:

a tub configured to accommodate dishes therein;

a plurality of wash arms configured to spray wash water into the tub;

a bubble nozzle configured to eject wash water containing microbubbles to a bottom of the tub;

a sump that is disposed below the bottom of the tub and that is configured to collect wash water therein;

a wash pump configured to pump wash water collected in the sump;

a bubble module that is configured to generate microbubbles in wash water pumped by the wash pump and that is configured to supply wash water containing microbubbles to the bubble nozzle; and a controller that is configured to operate the wash pump and control the bubble module to simultaneously (i) spray wash water through at least one of the plurality of wash arms and (ii) eject wash water through the bubble nozzle, wherein the at least one of the plurality of wash arms is configured to receive wash water pumped by the wash pump, and wherein, based on a magnitude of current of the wash pump being equal to or less than a predetermined value, the controller is configured to control the bubble module to block ejection of wash water through the bubble nozzle.

2. The dishwasher of claim 1, wherein the bubble nozzle is provided in a plurality thereof, wherein the bubble module is provided in a plurality thereof so as to match the plurality of bubble nozzles, and wherein the controller is configured to control the plurality of bubble modules to alternately eject wash water through the plurality of bubble nozzles.

3. The dishwasher of claim 2, wherein the controller is configured to control the plurality of bubble modules to simultaneously eject wash water through the plurality of bubble nozzles after alternately ejecting wash water.

4. The dishwasher of claim 1, further comprising:

a water supply valve is configured to supply wash water supplied from an external water source to the sump, wherein the controller is configured to control (i) the water supply valve to supply wash water to the sump and (ii) the wash pump and the bubble module to eject wash water through the bubble nozzle.

5. The dishwasher of claim 4, further comprising:

a heater configured to heat wash water supplied to the sump, wherein the controller is configured to control (i) the heater to heat wash water supplied to the sump and (ii) the wash pump and the bubble module to eject the heated wash water through the bubble nozzle.

6. The dishwasher of claim 1, further comprising:

a drain pump configured to discharge, to outside of the sump, wash water collected in the sump, wherein the controller is configured to control (i) the wash pump and the bubble module to stop ejection of wash water through the bubble nozzle and (ii) the drain pump to discharge, to outside of the sump, wash water collected in the sump.

7. A control method of a dishwasher comprising a tub configured to accommodate dishes therein, a plurality of wash arms configured to spray wash water into the tub, a bubble nozzle configured to eject wash water containing microbubbles to a bottom of the tub, and a sump that is disposed below the bottom of the tub and that is configured to collect wash water therein, the method comprising:

supplying wash water supplied from an external water source to the sump; and spraying wash water through at least one of the plurality of wash arms and simultaneously ejecting wash water containing microbubbles through the bubble nozzle, wherein, based on a magnitude of current of a wash pump being equal to or less than a predetermined value, blocking, by a bubble module, ejection of wash water through the bubble nozzle.

8. The method of claim 7, wherein ejecting wash water comprises alternately ejecting wash water through a plurality of bubble nozzles.

9. The method of claim 8, wherein ejecting wash water further comprises simultaneously ejecting wash water through the plurality of bubble nozzles after the alternately ejecting wash water.

10. The method of claim 7, further comprising, after supplying wash water, heating wash water collected in the sump.

11. The method of claim 7, further comprising, after spraying wash water and ejecting wash water, discharging, to outside of the sump, wash water collected in the sump.

* * * * *